US005490492A

United States Patent [19]

Savage

[11] Patent Number: 5,490,492

[45] Date of Patent: Feb. 13, 1996

[54] RETRACTING ARROW REST FOR ARCHERY BOW

[75] Inventor: Huey P. Savage, Lake Forest, Calif.

[73] Assignee: Savage Systems, Inc., Oak Grove, La.

[21] Appl. No.: 188,253

[22] Filed: Jan. 27, 1994

[51] Int. Cl.[6] ..... F41B 5/22

[52] U.S. Cl. ..... 124/44.5; 124/88

[58] Field of Search ..... 124/44.5, 24.1, 124/23.1, 88

[56] References Cited

U.S. PATENT DOCUMENTS

| | | | |
|---|---|---|---|
| 3,504,659 | 4/1970 | Babington | 124/44.5 X |
| 5,065,731 | 11/1991 | Smith | 124/24.1 X |
| 5,117,803 | 6/1992 | Johnson | 124/44.5 |
| 5,161,514 | 11/1992 | Cary | 124/44.5 X |
| 5,365,912 | 11/1994 | Pittman | 124/44.5 |

*Primary Examiner*—Anthony Knight
*Attorney, Agent, or Firm*—Roy A. Ekstrand

[57] ABSTRACT

A retracting arrow rest for archery bow is used in combination with a compound bow having a cable slide movable as the bow is drawn and released. A generally L-shaped body is secured to the cable guard of the compound bow and supports a rotatably positioned arrow guide having a tapered notch for receiving an arrow shaft. A lever is secured to the supporting shaft and is coupled to the cable slide by a flexible line. A pair of threaded stop members are adjustably positionable within the arrow rest body to interact with stop surfaces formed upon the rotatable end bearings supporting the shaft to provide travel limits for the arrow guide in both the retracted and extended positions.

23 Claims, 3 Drawing Sheets

FIG. 1
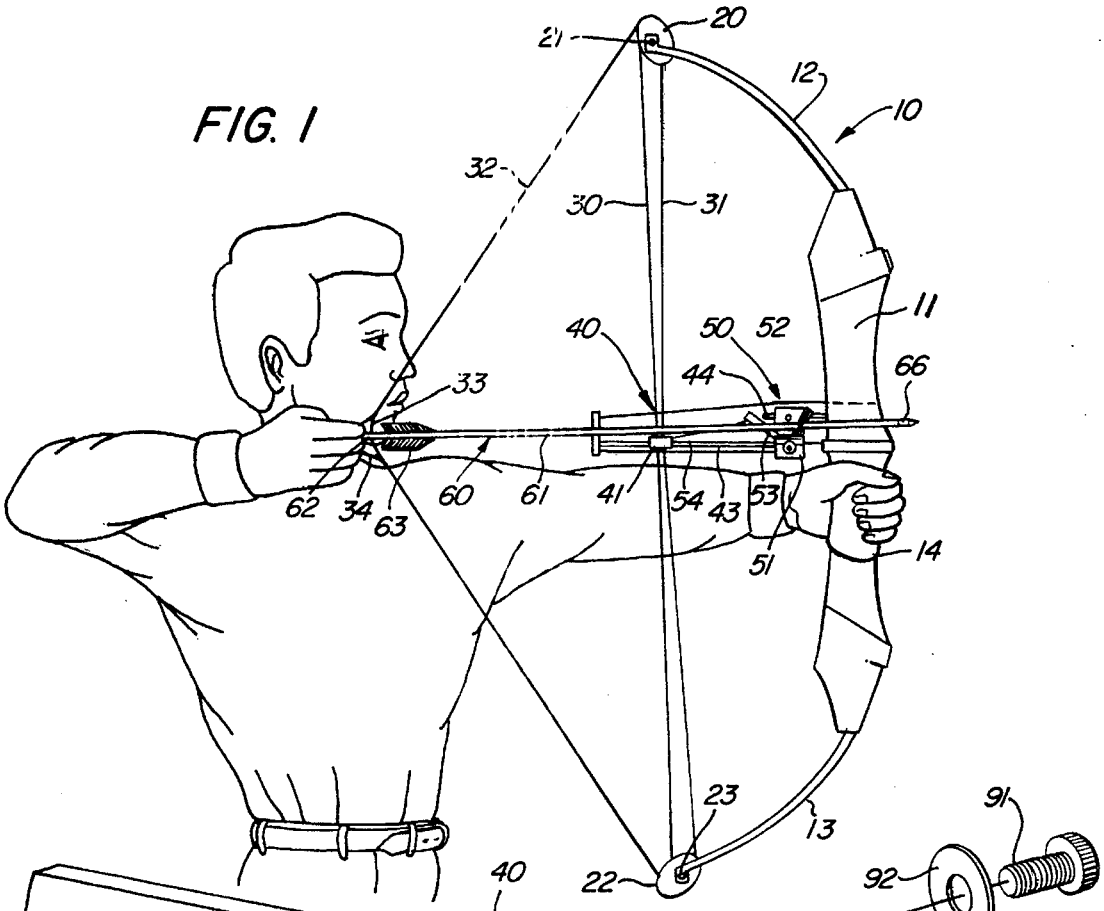
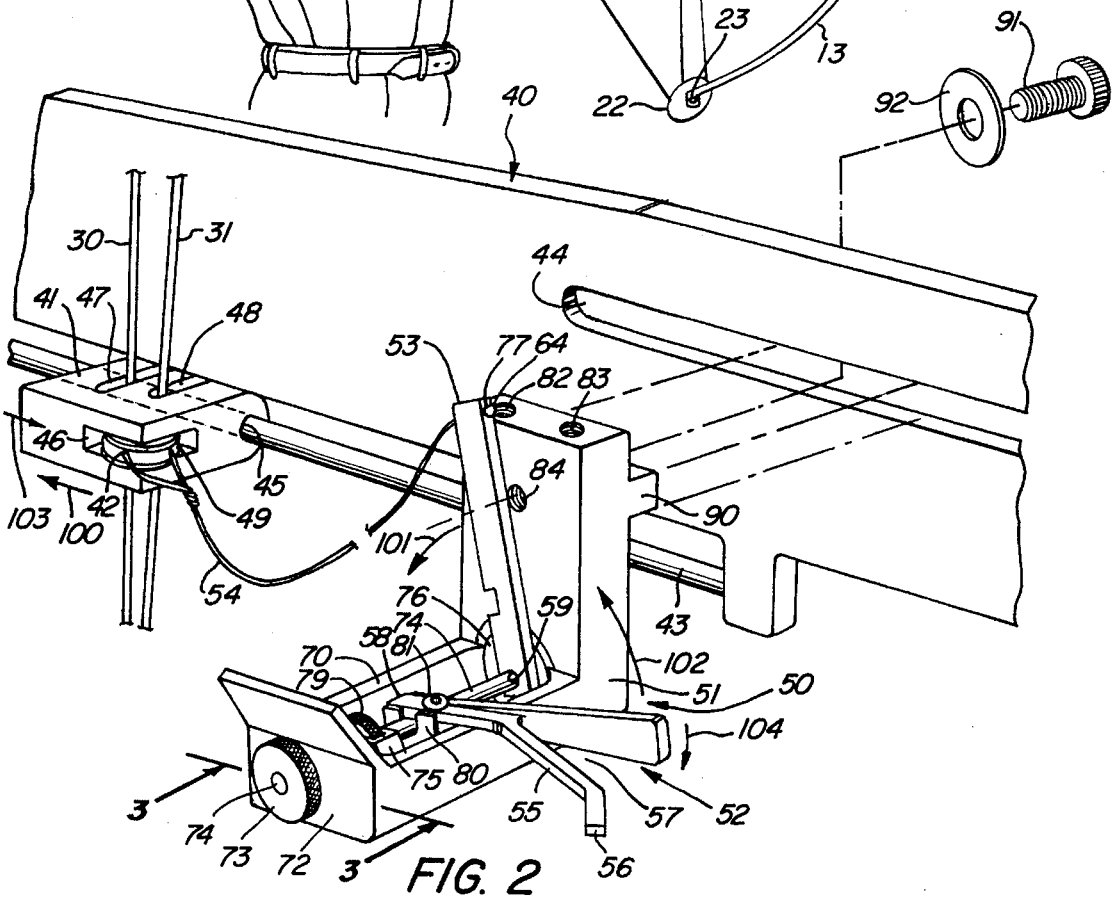
FIG. 2

RETRACTING ARROW REST FOR ARCHERY BOW

SPECIFICATION

1. Field of the Invention

This invention relates generally to archery apparatus and particularly to retracting arrow rests for use on archery bows intended to avoid or minimize contact between the arrow rest and the vanes of the arrow.

2. Background of the Invention

The sport of archery has enjoyed ever increasing popularity among a wide group of enthusiasts. The apparatus used in both target shooting and hunting has evolved to a considerable level of sophistication. To increase the power and accuracy of archery apparatus, practitioners in the art have developed compound bows which impart extraordinary energy to the arrows which they shoot. In a typical compound bow, an elongated rigid riser defines a hand grip and supports a pair of extending flexible limbs on either end. Each limb supports a rotatable eccentric wheel or cam to which a pair of cables and a bow string are secured. An arrow rest is supported upon the riser in some fashion to support the forward portion of the arrow shaft as the bow is drawn and aimed.

Arrows themselves have enjoyed considerable development and have evolved from simple wooden shaft implements with feather fletchings and fixed arrow heads or points to modern high strength lightweight arrows using hollow aluminum alloy shafts or composite materials which support threaded inserts and removable interchangeable points or heads. The traditional feather fletchings have generally been replaced by plastic fletchings or vanes and the arrow nock is typically formed of a high strength molded material such as plastic or the like.

When an archer fits an arrow to the bow, the nock is fitted to the bow string at a point referred to as the nocking point and the front portion of the arrow is rested within the arrow rest. The arrow and bow string are then drawn back flexing the limbs and rotating the eccentric wheels to store energy in the bow. Once the bow is drawn, the nocking point on the bow string and the arrow rest define an axis often referred to as the shooting axis alongwhich the arrow is launched when the bow string of the drawn bow is released. As the arrow is accelerated from the bow, the vanes often contact or brush the arrow rest causing an unpredictable and undesirable deflection of the arrow which degrades the accuracy of the archer.

In attempting to overcome the problems associated with arrow rest deflection through contact with the arrow vanes, practitioners in the art have developed various apparatus such as flexible or movable arrow rests intended to move from the arrow's path as the vanes contact the arrow rest.

Another approach to the arrow rest vane contact deflection problem utilizes mechanisms which sense the shock to the bow when the bow string is released and are operative to respond by quickly moving the arrow rest to a retracted position. This type of mechanism, however, has been found unreliable due to an inability to accurately time the arrow rest retraction. In such devices, premature arrow rest retraction allows the arrow to drop during acceleration while late or slow arrow rest retraction permits the vanes to contact the arrow rest.

There remains therefore a continuing need in the art for a retracting arrow rest for an archery bow which effectively and reliably supports the arrow prior to launch and which is retracted in the appropriate time sequence to avoid undesired deflection of the arrow.

SUMMARY OF THE INVENTION

Accordingly, it is a general object of the present invention to provide an improved retracting arrow rest for archery bow. It is a more particular object of the present invention to provide an improved retracting arrow rest for archery bow in which the timing of the arrow rest retraction is appropriate for maintaining shooting accuracy.

In accordance with the present invention, there is provided for use in combination with an archery bow and arrow, a retracting arrow rest comprises: a cable slide movable as the bow is drawn; a body secured to the bow at a position forward of the cable slide; an arrow guide having an arrow-receiving notch formed therein; support means for rotatably supporting the arrow guide upon the body rotatable between a raised position and a retracted position; coupling means for coupling the support means to the cable slide; and spring means for urging the support means toward the retracted position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a side view of a typical compound bow utilizing the present invention retracting arrow rest in the drawn bow position;

FIG. 2 sets forth a perspective assembly view of a retracting arrow rest constructed in accordance with the present invention;

DESCRIPTION OF THE PREFERRED EMBODIMENT

Figure 3:
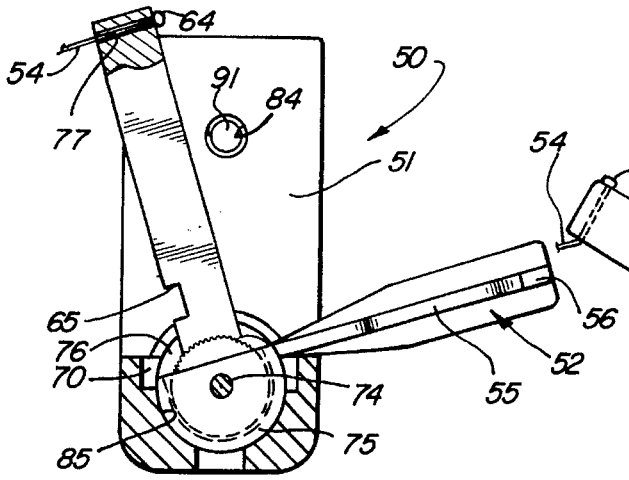
FIG. 3 sets forth a section view of the present invention retracting arrow rest taken along section lines 3—3 in FIG. 2 showing the arrow rest in the retracted position.

FIG. 1 sets forth a side view of a compound bow generally referenced by numeral 10 having an arrow rest constructed in accordance with the present invention and generally referenced by numeral 50. Compound bow 10 includes an elongated generally rigid riser 11 defining a hand grip 14 and supporting a pair of extending flexible limbs 12 and 13. Limbs 12 and 13 rotatably support a pair of eccentric wheels or cams 20 and 22 through the attachment of a pair of shafts 21 and 23 respectively. In accordance with conventional fabrication techniques, compound bow 10 further includes a pair of flexible cables 30 and 31 coupled to eccentric wheels 20 and 22 in the conventional manner. A bow string 32 is secured between eccentric wheels 20 and 22 and defines a nocking point 33 and a flexible loop 34 extending on either side of nocking point 33.

Compound bow 10 further includes a cable guard 40 secured to riser 11 above grip 14 in accordance with conventional fabrication techniques and extending rearwardly therefrom. Cable guard 40 supports a horizontal shaft 43 and defines an elongated slot 44. A cable slide 41 is slidably supported upon shaft 43. As is better seen in FIG. 2, cables 30 and 31 pass through cable slide 41.

In accordance with the present invention, an arrow rest generally referenced by numeral 50 includes a generally L-shaped body 51 secured to cable guard 40. Arrow rest 50 includes a lever 53 coupled to an arrow guide 52 in the manner set forth below in FIG. 2 in greater detail. Suffice it to note here, however, that lever 53 is coupled to cable slide 41 by a flexible line 54 and to further note that arrow guide 52 and lever 53 pivot within body 51 as a single assembly.

Finally, an arrow generally referenced by numeral 60 and constructed in accordance with conventional fabrication techniques includes an elongated shaft 61 having a point 66 at the forward end thereof and an arrow nock 62 at the rearward end thereof. Nock 62 is received upon and engages bow string 32 at nocking point 33. Arrow 60 further includes a plurality of conventional vanes 63 secured to shaft 61 forwardly of arrow nock 62.

In operation, the archer initially grasps grip 14 and while holding compound bow 10 secures nock 62 of arrow 60 to bow string 32 at nocking point 33 and thereafter rests shaft 61 of arrow 60 upon arrow guide 52. As is set forth below in greater detail, arrow guide 52 and lever 53 are spring-biased toward the retracted position better seen in FIG. 3 in which lever 53 assumes a generally vertical orientation and arrow guide 52 assumes a generally horizontal inclination. As the archer grasps loop 62 and begins drawing bow string 32 and 60 however, cable slide 41 is moved rearwardly upon shaft 43 causing flexible line 54 to draw lever 53 rearwardly and pivot lever 53 in the counterclockwise direction which in turn raises arrow guide 52. Once bow 10 has been drawn to the desired position generally corresponding to that shown in FIG. 1, arrow guide 52 has been raised to the generally vertical inclination shown in FIG. 1 providing the appropriate support for arrow 60. Thereafter, as the archer maintains the drawn position of bow 10, arrow 60 is securely supported within arrow guide 52 and the archer is able to aim and target the desired object. As the archer releases loop 34 of bow string 32, the stored energy within limbs 12 and 13 is released and arrow 60 is accelerated forwardly along an axis known as the shooting axis defined between nocking point 33 and the resting position of arrow 60 within arrow guide 52. Concurrently, the release of bow string 32 by the archer permits eccentric wheels 20 and 22 to rotate moving cables 30 and 31 forwardly causing cable slide 41 to also move forwardly. The forward motion of cable slide 41 relieves the maintaining tension upon flexible line 54 permitting the stored spring energy within arrow rest 50 to pivot lever 53 and arrow guide 52 in the clockwise direction lowering arrow guide 52 to the retracted position seen in FIG. 3. As arrow 60 continues to be accelerated by the action of limbs of 12 and 13 acting through bow string 32, cable slide 41 continues to move forwardly upon shaft 43 until arrow guide 52 has moved to its fully retracted position. In accordance with an important aspect of the present invention, the rotation of arrow guide 52 occurs in proper timing relationship to the advance of arrow 60 such that vanes 63 do not contact arrow guide 52 as arrow 60 leaves bow 10. Thus, the above-described arrow rest contact with the vanes of arrow 60 is avoided by the properly timed retraction of arrow guide 52. Also, the retracting movement of the arrow rest is sufficiently rapid to minimize contact with the arrow shaft as the arrow undergoes the normal flexing or arching in response to the bow string acceleration. It has been determined that the present invention arrow rest is completely free of the arrow shaft before the arrow moves forward a distance of one inch.

In accordance with a further important advantage of the present invention arrow rest described below in greater detail, the travel limits of arrow guide 52 and lever 53 are adjustable to control the movement of arrow guide 52 and optimize the operation of arrow rest 50 for different shooting conditions and arrow characteristics. In accordance with a further advantage of the present invention arrow rest described below in FIG. 2 in greater detail, the position of arrow rest 50 upon cable guard 40 may be adjusted by moving body 51 within slot 44. This is particularly advantageous for accommodating a variety of arrow lengths. In addition, the attachment of body 51 to cable guard 40 permits body 51 to be completely removed from cable guard 40 and repositioned on the opposite side thereof. Thus, while FIG. 1 sets forth the configuration of compound bow 10 and arrow rest 50 corresponding to a right hand archer using a left hand grip upon riser 11 and a right hand bow string pull, a left hand archer using a right hand grip upon riser 11 and a left hand pull upon bow string 32 may be readily accommodated by the present invention arrow rest. In such case, cable guard 41 is positioned in the reverse of its position shown in FIGS. 1 and 2 while body 51 is secured to the opposite side of cable guard 40. As is better seen in FIG. 2, the reversal of arrow rest 50 for a left hand archer is completed by reversing the positions of arrow guide 52 and lever 53 with respect to shaft 74. Thus, the present invention retracting arrow rest is able to readily accommodate both right hand and left hand archers.

FIG. 2 sets forth a perspective assembly view of a retracting arrow rest constructed in accordance with the present invention. As described above, compound bow 10 includes an elongated generally planar cable guard 40 defining an elongated slot 44 and supporting a shaft 43. A cable slide 41 defines a bore 45 which receives shaft 43 to slidably secure cable slide 41 to shaft 43. Cable slide 41 further defines a pair of slots 47 and 48 through which cables 30 and 31 of compound bow 10 pass to provide coupling between cable slide 41 and cables 31 and 32. Cable slide 41 further defines a corner channel 46 within which a generally planar disk 49 is rotatably supported. Disk 49 defines an aperture 42 through which one end of flexible line 54 passes to secure one end of line 54 to disk 49.

Arrow rest 50 includes a generally L-shaped body 51 preferably formed of an aluminum or composite material or virtually any other lightweight material having substantial rigidity. Body 51 defines a horizontal portion having a channel 70 formed therein and a closed end 72. Body 51 further defines a vertical portion having a horizontally disposed locating rib 90 on the rear surface thereof. A threaded aperture 84 is defined within body 51 and extends through locating rib 90. A pair of additional threaded apertures 82 and 83 are formed within the vertical portion of body 51 in the manner better seen in FIGS. 7 and 8 below.

Body 51 is securable to cable guard 40 by positioning locating rib 90 within slot 44 and moving body 51 to the desired position. Thereafter, a conventional fastener 91 supporting a washer 92 is threadably secured within aperture 84 from the reverse side of cable guard 40 and tightened to produce sufficient holding force to secure body 51.

An elongated generally cylindrical shaft 74 is rotatably supported within channel 70 by a bearing 76 at its interior end and within an aperture 71 formed in end 72 of body 51. Lever 53 is secured to shaft 74 in a fixed attachment by the tight fit of shaft 74 within aperture 59 formed at the lower end of lever 53. The upper end of lever 53 defines an aperture 77 which receives the remaining end of flexible line 54. A guide support 80 is secured to shaft 74 and receives end 58 of arrow guide 52 in a secure attachment using fastener 81. The structure of guide support 80 is set forth below in FIG. 6 in greater detail. However, suffice it to note here that guide support 80 is secured to shaft 74 and rotatable therewith. It should further be noted that the attachment of guide support 80 to shaft 74 may be released by loosening fastener 81 which facilitates the lateral movement of guide support 80 upon shaft 74 in the manner set forth below in FIG. 5. Arrow guide 52 further includes an angled finger 55 having an outwardly angled end portion 56. Angled finger 55 and arrow guide 52 form a tapered notch 57 therebetween which as described above receives and supports the forward portion of arrow 60. A fine position adjuster 75 is received upon shaft 74 and supports a threaded adjustment wheel 79. As is better seen in FIG. 5, fine position adjuster 75 and adjusting wheel 79 are threadably coupled to shaft 74 and provide a fine position adjustment in the axial direction for shaft 74 which in turn provides a fine position adjustment for arrow guide 52. The course position of arrow guide 52 is adjusted by loosening fastener 81 to release the attachment of guide support 80 to shaft 74 and facilitate repositioning of arrow guide 52 upon shaft 74 in the manner also better seen in FIG. 5.

The assembly of arrow rest 50 to cable guard 40 is carried forward by initially locating rib 90 within slot 44 and thereafter threading fastener 91 bearing washer 92 from the reverse side of cable guard 40 into threaded aperture 84. The front to back position of arrow rest 50 upon cable guard 40 is then selected and fastener 91 is tightened to secure body 51 to cable guard 40. By means set forth below in greater detail, the angular positions of arrow guide 52 and lever 53 in the retracted position shown in FIG. 2 is set by adjusting a threaded stop 110 (seen in FIG. 7) within threaded aperture 82. The limit position of arrow guide 52 and lever 53 in the raised or extended position seen in FIG. 1 is set by adjusting threaded stop 120 also better seen in FIG. 7 within threaded aperture 83. The course position of arrow guide 52 upon shaft 74 is initially set by loosening fastener 81 and sliding guide support 80 upon shaft 74. Thereafter, fastener 81 is tightened to secure arrow guide 52. Finally, the lateral position of arrow guide 52 may be given a fine adjustment by moving adjusting wheel 79 of fine adjuster 75. Once the desired position of arrow guide 52 is obtained, lock wheel 73 which is threadably received upon the outer end of shaft 74 is tightened to maintain the desired adjustment. With the assembly of arrow rest 50 to cable guard 40 thus completed, the present invention retracting arrow rest is ready for use in the manner described above in FIG. 1. Thus, as the user draws bow string 32, cables 30 and 31 move cable slide 41 rearwardly in the direction indicated by arrow 100. As is better seen in FIG. 7, the angular position of shaft 74, arrow guide 52 and lever 53 is spring-biased toward the retracted position in the direction indicated by arrow 104. Thus, as cable slide 41 moves rearwardly in the direction indicated by arrow 100, the slack is removed from line 54 afterwhich further movement of cable slide 41 pivots lever 53 in the direction indicated by arrow 101 which in turn raises arrow guide 52 in the direction indicated by arrow 102 toward the extended position shown in FIG. 1. As the archer releases the drawn bow string, cable slide 41 is moved forwardly in the direction indicated by arrow 103 releasing the tension upon line 54 and permitting lever 53, shaft 74 and arrow guide 52 to be rotated in the direction indicated by arrow 104 in response to the above-described spring force thereby pivoting arrow guide 52 downwardly away from the previously supported arrow as the arrow is accelerated from the bow. The downward pivotal motion of arrow guide 52 provides the desired clearance between arrow guide 52 and the vanes of the arrow being launched.

Figure 4:
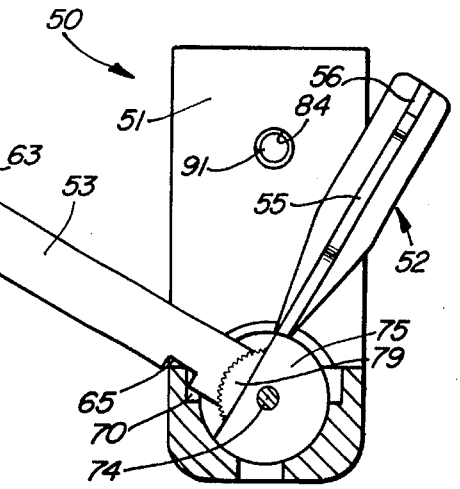
FIG. 4 sets forth a section view of the present invention retracting arrow rest taken along section lines 3—3 in FIG. 2 showing the arrow rest in the raised arrow supporting position.

FIGS. 3 and 4 set forth section views of the present invention arrow rest taken along section lines 3—3 in FIG. 2. FIG. 3 shows arrow rest 50 in the retracted position while FIG. 4 shows arrow rest 50 in the extended or raised position.

More specifically with reference to FIG. 3, arrow rest 50 includes a body 51 defining an aperture 84 within which a threaded fastener 91 is received. Body 51 further defines a channel 70 and a recess 85. Recess 85 receives a semicylindrical fine position adjuster 75 having an adjusting wheel 79. A cylindrical shaft 74 is threadably received within adjusting wheel 79 and extends through wheel 76 in a threaded engagement. Shaft 74 extends outwardly from fine adjuster 75 through an aperture 71 (seen in FIG. 5). A bearing 76 is supported within body 51 in the manner better seen in FIGS. 7 and 8 below and provides support for the remaining end of shaft 74. Shaft 74 supports an arrow guide 52 having an angled finger 55 and an end 56. Finger 55 and arrow guide 52 form a tapered notch 57 (seen in FIG. 2). Arrow guide 52 is secured to shaft 74 and is rotatable therewith in the manner described above. Arrow rest 50 further includes a lever 53 defining an aperture 77 at the outer end thereof. A flexible line 54 extends through aperture 77 and terminates in an enlarged knot 64. Lever 53 is secured to shaft 74 and rotatable therewith. A notch 65 is formed within lever 53 and, as is better seen in FIG. 4, provides a clearance notch facilitating the rotational movement of lever 53.

In the retracted position shown in FIG. 3, arrow guide 52 is nearly horizontal while lever 53 approaches a vertical position. In this position, arrow guide 52 is withdrawn from the travel path of a launched arrow and thus arrow guide 52 does not interfere with the passage of the arrow.

With specific reference to FIG. 4, arrow rest 50 is shown in the raised position in which arrow guide 52 assumes a nearly vertical position while lever 53 approaches a horizontal position. Of interest to note in FIG. 4 is the clearance provided by notch 65 against the upper portion of channel 70 within body 51. Notch 65 is sufficient in depth to permit the full angular travel motion of lever 53. In the position shown in FIG. 4, the tapered notch (notch 57 shown in FIG. 2) formed between angled finger 55 and arrow guide 52 readily receives and supports an arrow shaft in the above-described manner to provide a reliable position and predictable location for the arrow shaft as the bow is drawn and aimed by the archer. As described above, the raised position of arrow rest 50 is achieved due to the tension applied to flexible line 54 drawing lever 53 to the position shown in FIG. 4. As is also described above, once the tension upon line 54 is released, the spring bias (seen in FIGS. 7 and 8) applied to bearing 76 and shaft 74 abruptly pivots arrow guide 52 and lever 53 to the retracted position shown in FIG. 3.

Figure 5:
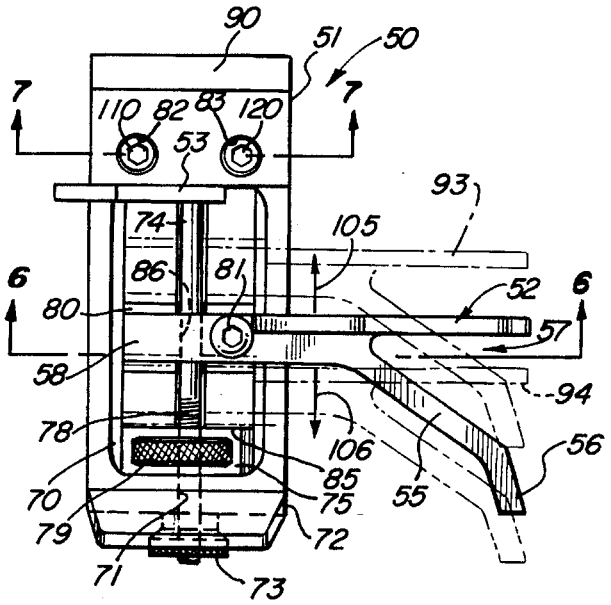
FIG. 5 sets forth a top view of the present invention retracting arrow rest.

FIG. 5 sets forth a top view of the present invention arrow rest. As described above, arrow rest 50 includes a generally L-shaped body 51 defining a locating rib 90 which as is seen in FIG. 2 is received within slot 44 of cable guard 40. Body 51 further defines an upwardly extending vertical portion having threaded apertures 82 and 83 formed therein in the manner better seen in FIGS. 7 and 8. Body 51 further defines a horizontal portion having a channel 70 formed therein. A recess 85 extends into channel 70 and receives a fine position adjuster 75. Position adjuster 75 supports a threaded adjustment wheel 76. An elongated cylindrical shaft 74 is supported at one end within body 51 by a bearing 76 (seen in FIG. 30). Shaft 74 extends through the approximate center of channel 70 and passes outwardly through end 72 of body 51 via an aperture 71 formed therein. Shaft 74 defines a threaded end portion 78 which receives a lock wheel 73 in a threaded attachment from the outside of end 72 of body 51. Adjusting wheel 79 defines a threaded interior aperture which is threadably received upon threads 78 of shaft 74. Fine adjuster 75 is loosely captivated within recess 85 at the position shown in FIG. 5 and is pivoted along with shaft 84 in the above-described pivotal motion. A generally U-shaped guide support defines a slot 86 through which shaft 84 passes. An arrow guide 52 includes an end 58 received upon the upper portion of guide support 80 and extending across slot 86 therein. A fastener 81 is threadably received within guide support 80 in the manner shown in FIG. 6 and provides a clamping attachment between end 58 of arrow guide 52 and guide support 80 upon shaft 74 to secure arrow guide 52 to shaft 74. The bottom portion of guide support 80 defines a semicylindrical surface which is rotatable within channel 70 in the manner shown in FIG. 6.

Figure 8:
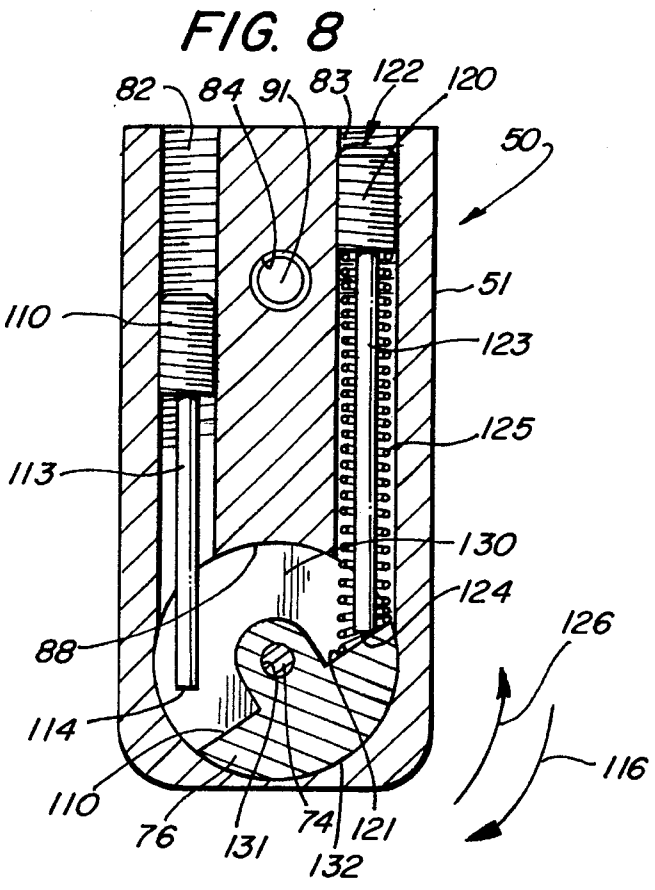
FIG. 8 sets forth a section view of the present invention retracting arrow rest taken along section lines 7—7 in FIG. 5 in the raised or extended position.
Figure 7:
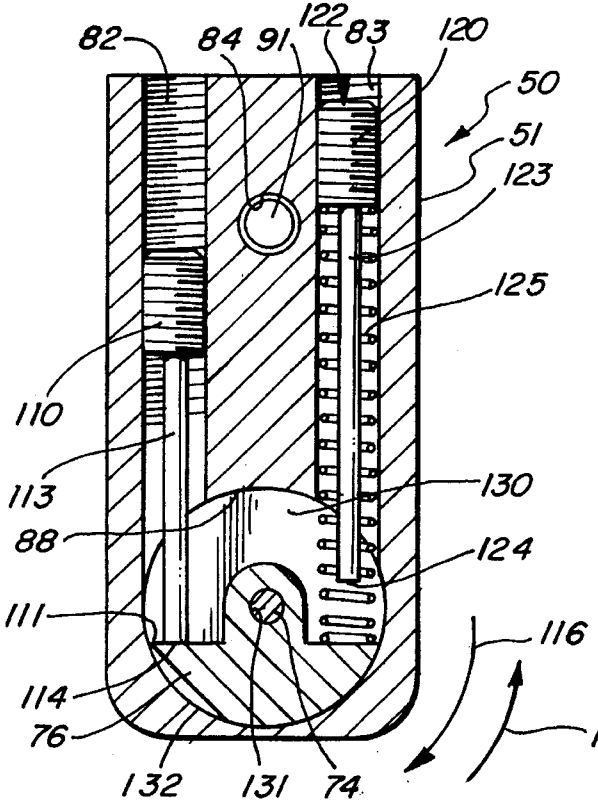
FIG. 7 sets forth a section view of the present invention retracting arrow rest taken along section lines 7—7 in FIG. 5 in the retracted position.

Arrow guide 52 includes an angled finger 55 extending therefrom and having a more severely angled end portion 56. Angled finger 55 and arrow guide 52 define a tapered notch 57 therebetween which provides the resting surface for the arrow shaft of arrow rest 50 in the manner described above in FIG. 1. Lever 53 is secured to shaft 74 and rotatable therewith. A pair of threaded stop members 110 and 120 are threadably received within apertures 82 and 83 of body 51 and in the manner set forth below in FIGS. 7 and 8 provide angular position limits for the rotation of shaft 74.

In operation, the lateral position of arrow guide 52 may be provided with a course position alignment by loosening fastener 81 to release the clamping attachment of guide support 80 and end portion 58 upon shaft 74 and thereafter sliding guide support 80 and arrow guide 52 in either of the lateral directions indicated by arrows 105 and 106. Thus, guide support 80 and arrow guide 52 may be moved in the direction indicated by arrow 105 to a position such as that shown by dashed-line representation 93 or, alternatively, moved in the direction indicated by arrow 106 to the position shown by dashed-line representation 94 or any intermediate position desired. Once the course adjustment of arrow guide 52 upon shaft 74 is obtained, fastener 81 is again tightened to securely clamp end 58 of arrow guide 52 and guide support 80 upon shaft 74. Thereafter, lock wheel 83 is threaded outwardly from end 72 to further release shaft 74. This facilitates a fine adjustment of the lateral position of shaft 74 and thereby arrow guide 52 by rotating adjusting wheel 79 of fine adjuster 75 in either direction. The threaded engagement of adjusting wheel 79 upon threads 78 provides a fine lateral shifting of shaft 74 to move arrow guide 52. Once the desired position has been obtained, lock wheel 73 is again tightened against end 72 to provide position attachment and secure the adjustment. Once fastener 81 is secured and lock wheel 73 is tightened upon shaft 74, arrow rest 50 is ready for adjustment of threaded stops 110 and 120 to define the angular position limits of the pivotal motion of lever 53, shaft 74 and arrow guide 72 in the manner described above to either raise or retract arrow guide 52. The adjustment of limit stops 110 and 120 is set forth below in FIGS. 7 and 8 in greater detail. However, suffice it to note here that the position of threaded stop 110 is adjusted to define the retracted position of arrow guide 52 while threaded stop 120 is adjusted to define the raised position of arrow guide 52.

Figure 6:
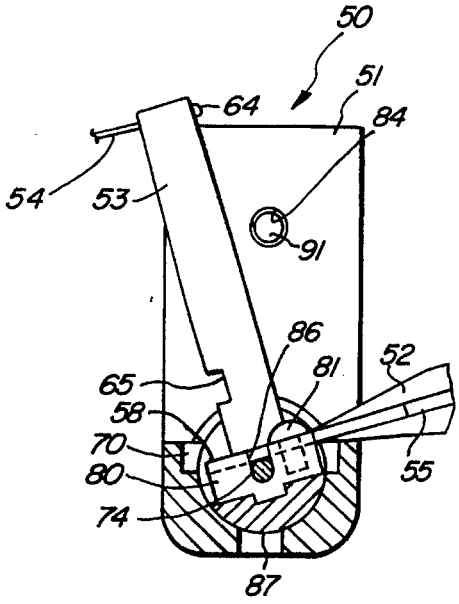
FIG. 6 sets forth a section view of the present invention retracting arrow rest taken along section lines 6—6 in FIG. 5.

FIG. 6 sets forth a section view of the present invention arrow rest taken along section lines 6—6 in FIG. 5. As described above, arrow rest 50 includes a body 51 defining an aperture 84 which receives a threaded fastener 91 to secure body 51 against cable guard 40 (seen in FIG. 2). As is also described above, body 51 defines a channel 70 which receives a guide support 80 having a semicylindrical surface 87 defined on the lower portion thereof. A shaft 74 extends through channel 70 and passes through a slot 86 formed in guide support 80. An arrow guide 52 includes an angled finger 55 and an end portion 58. The latter is received upon guide support 80 covering slot 86 and captivating shaft 74 therein. A conventional fastener 81 is threadably received within apertures defined in arrow guide 52 and guide support 80 to secure end 58 of arrow guide 52 upon guide support 80. Lever 53 defines a notch 65 and is secured to shaft 74 at its lower end and is further secured to a flexible line 54 having a knot 64 formed therein.

Of particular interest in FIG. 6 is the clamping action of fastener 81 upon end 58 of arrow guide 52 which secures guide support 80 and arrow guide 52 to shaft 74. As is described above in connection with FIG. 5, the loosening of fastener 81 releases the clamping action upon shaft 74 and facilitates the lateral position adjustment of guide support 80 and arrow guide 52 upon shaft 74.

FIGS. 7 and 8 set forth section views of the present invention arrow rest taken along section lines 7—7 in FIG. 5. FIG. 7 shows the present invention arrow rest in the retracted position corresponding to FIG. 3 while FIG. 8 shows the present invention arrow rest in the raised position shown in FIG. 4. In accordance with an important aspect of the present invention, each position or travel limit of the present invention arrow rest is independently controlled or adjustable.

Thus, with simultaneous reference to FIGS. 7 and 8, arrow rest 50 includes a body 51 defining a pair of threaded apertures 82 and 83 extending vertically therethrough. Body 51 further defines a cylindrical bearing recess 88 which receives a generally cylindrical bearing 76 having an outer cylindrical bearing surface 132 fitted within recess 88. Thus, bearing 76 is freely rotatable within bearing recess 88. Bearing 76 defines an aperture 131 which receives the end portion of shaft 74 in a secure tight or force fit to couple shaft 74 to bearing 76. Alternatively, other fastening means may be used to secure shaft 74 to bearing 76. Bearing 76 further defines a channel portion 130 extending through the upper center portion of bearing 76 and terminating on each side of shaft 74 in a pair of generally horizontal stop surfaces 111 and 121.

A threaded stop 110 is threadably received within aperture 82 and includes a downwardly extending cylindrical rod 113 having an end 114 at the lower portion thereof. The position of threaded stop 110 within threaded aperture 82 is adjusted by rotating stop 110. In its preferred form, threaded stop 110 defines a hexagonal socket 112 (seen in FIG. 9) which receives a standard allen wrench for each of rotational adjustment. The position of end 114 with respect to stop 111 defines the travel limit of bearing 76 and as a result shaft 74 in the clockwise direction indicated by arrow 116. Thus, as stop 111 contacts end 114, the fully retracted position of arrow guide 52 (seen in FIG. 3) is defined. It will be apparent that moving threaded stop 110 in either direction adjusts this angular travel limit.

Similarly, a threaded stop 120 is received within threaded aperture 83 and includes a downwardly extending rod 123 having an end 124. A coil spring 125 is received upon rod 123 within the lower portion of threaded aperture 83 and is captivated between stop surface 121 and the undersurface of threaded stop 120. The position of end 124 is adjusted by rotation of threaded stop 120. Coil spring 125 is compressed between stop surface 121 and threaded stop 120 to provide a spring force acting upon stop surface 121 urging rotation of bearing 76 in the direction indicated by arrow 116. Thus, spring 125 acting upon stop surface 121 of bearing 76 provides the above-described return spring force which urges the present invention arrow rest toward the retracted position shown in FIG. 3. As mentioned above, FIG. 7 depicts the fully retracted position of the present invention arrow rest. As shaft 74 is rotated in the direction indicated by arrow 126 due to the above-described action in which the archer draws compound bow 10 (seen in FIG. 1) causing cable slide 41 to draw flexible line 54 and rotate lever 53 (also shown in FIG. 1), the spring force of spring 125 is overcome and bearing 76 rotates. As bearing 76 rotates in the direction indicated by arrow 126, stop 121 is brought into contact with end 24 of threaded stop 120. This contact provides the travel limit for the present invention arrow rest in the raised position shown in FIG. 4 and is adjustable by moving threaded stop 120.

FIG. 8 shows the resulting configuration of the present invention arrow rest as spring 125 is compressed and the arrow rest is brought to the fully raised position. End 124 is shown contacting stop 121 limiting further travel of bearing 76 and thereby shaft 74 in the direction indicated by arrow 126. The compression of spring 125 continues to provide a spring force acting upon stop surface 121 urging bearing 76 in the direction indicated by arrow 116. As a result once the archer has released the drawn bow and the flexible line secured to lever 53 (seen in FIG. 1) is released, spring 125 immediately pivots bearing 76 and shaft 74 in the direction of arrow 116 quickly returning the arrow rest to the retracted position shown in FIG. 3.

Figure 9:
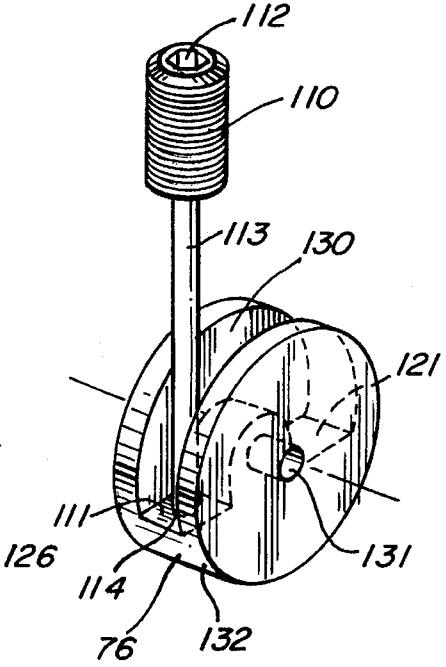
FIG. 9 sets forth a perspective view of a typical limit stop element used in the present invention retracting arrow rest.

FIG. 9 sets forth a perspective view of threaded stop 110 and bearing 76. As described above, threaded stop 110 includes a downwardly extending rod 113 having an end 114 and a hexagonal socket 112. As is also described above, bearing 76 defines a generally cylindrical bearing member having an aperture 131 formed therein and a cylindrical bearing surface 132 about its exterior. A channel 130 extends through bearing 76 and defines stop surfaces 111 and 121 on either side of aperture 131.

What has been shown is a retracting arrow rest for archery bow which utilizes a pivotally supported arrow guide having a lever and flexible line coupling to the cable slide of a compound bow. The cooperation of the flexible and pivoting lever automatically raises the arrow guide to the extended arrow supporting position as the bow is drawn and immediately pivots the arrow guide to a retracted position as the bow is released. The retracting mechanism is effective and responds quickly to the bow release and utilizes a reliable return spring configuration which is virtually trouble free. The entire unit may be fabricated largely from lightweight aluminum metal parts or their equivalent or molded plastic or composite materials as desired. The arrow rest is adjustable in its lateral position using a course adjustment and an independent fine adjustment. The travel limits of the arrow guide in both the retracted and extended positions are independently adjustable.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with an archery bow and arrow, a retracting arrow rest comprising:

a cable slide movable as said bow is drawn;

a body secured to said bow at a position forward of said cable slide;

an arrow guide having an arrow-receiving notch formed therein;

support means for rotatably supporting said arrow guide upon said body rotatable between a raised position and a retracted position, said support means including adjustable stop means for limiting the rotational movement of said arrow guide in both rotational directions;

coupling means for coupling said support means to said cable slide; and spring means for urging said support means toward said retracted position.

2. A retracting arrow rest as set forth in claim 1 wherein said support means includes a shaft rotatably supported upon said body and a lever having a first end secured to said shaft and a second end, and wherein said coupling means includes a flexible line having one end secured to said cable slide and the remaining end secured to said second end of said lever.

3. A retracting arrow rest as set forth in claim 2 wherein said arrow guide is removably secured to said shaft.

4. A retracting arrow rest as set forth in claim 3 wherein said support means further includes fine position adjusting means for changing the position of said arrow guide with respect to said body.

5. A retracting arrow rest as set forth in claim 4 wherein said arrow guide includes a straight portion and an angled finger extending therefrom, said straight portion and said angled finger forming said arrow-receiving notch therebetween.

6. A retracting arrow rest as set forth in claim 5 wherein said bow includes a handle grip and a cable guard extending rearwardly therefrom and wherein said body is attachable to said cable guard.

7. A retracting arrow rest as set forth in claim 6 wherein said cable slide is slidably supported upon said cable guard.

8. A retracting arrow rest as set forth in claim 7 wherein said body is attachable to said cable guard in either a first orientation to accommodate right handed archers or a second position to accommodate left handed archers.

9. A retracting arrow rest as set forth in claim 8 wherein said support means are reversible within said body to accommodate either right handed or left handed archers.

10. A retracting arrow rest as set forth in claim 1 wherein said bow includes a handle grip and a cable guard extending rearwardly therefrom and wherein said body is attachable to said cable guard.

11. A retracting arrow rest as set forth in claim 10 wherein said cable slide is slidably supported upon said cable guard.

12. A retracting arrow rest as set forth in claim 11 wherein said body is attachable to said cable guard in either a first orientation to accommodate right handed archers or a second position to accommodate left handed archers.

13. A retracting arrow rest as set forth in claim 12 wherein said support means are reversible within said body to accommodate either right handed or left handed archers.

14. For use in combination with a compound bow having a riser supporting a pair of flexible limbs and rotatable eccentric wheels coupled by a pair of cables, a cable guard extending from the riser and a cable slide slidably supported upon the cable guard and coupled to the cables, a retracting arrow rest comprising:

a body secured to said cable guard proximate the riser defining a bearing recess;

a shaft;

bearing means for rotatably supporting said shaft upon said body, said bearing means including a generally cylindrical bearing supporting said shaft rotatable within said bearing recess;

a lever having a first end secured to said shaft and a second end;

an arrow guide secured to said shaft and defining an arrow notch;

a flexible line having one end attached to said second end of said lever and the remaining end attached to said cable slide; and a spring coupled to said shaft urging rotation of said shaft in a direction which lowers said arrow guide, said shaft being rotated as said lever is pivoted rotating said arrow guide to a raised position as the bow is drawn and as the cable slide is moved upon the cable guard and said spring rotating said shaft once the drawn bow is released to lower said arrow guide.

15. A retracting arrow rest as set forth in claim 14 wherein said bearing defines a pair of stop surfaces and wherein said retracting arrow rest further includes a pair of limit stops adjustably supported by said body contacting said pair of stop surfaces to limit rotational motion of said bearing and said shaft.

16. A retracting arrow rest as set forth in claim 15 wherein said body defines a pair of threaded apertures and wherein said pair of limit stops include threaded portions received within said threaded apertures each having end portions for contacting said stop surfaces.

17. A retracting arrow rest as set forth in claim 16 wherein said spring is received upon one of said end portions of one of said limit stops and is captivated between said threaded portion thereof and one of said stop surfaces.

18. A retracting arrow rest as set forth in claim 14 wherein said arrow guide includes:

a guide support having an upper surface and a transverse notch receiving said shaft;

an elongated straight member having a first end portion overlying said upper surface and said transverse notch and a second end defining said arrow notch; and a fastener removably securing said first end portion of said elongated straight member to said upper surface of said guide support to grasp said shaft.

19. A retracting arrow rest as set forth in claim 18 wherein said elongated member includes a straight portion and an angled finger forming said arrow notch therebetween.

20. For use in combination with a compound bow having a riser supporting a pair of flexible limbs and rotatable eccentric wheels coupled by a pair of cables, a cable guard extending from the riser and a cable slide slidably supported upon the cable guard and coupled to the cables, a retracting arrow rest comprising:

a body secured to said cable guard proximate the riser;

a shaft;

bearing means for rotatably supporting said shaft upon said body;

a lever having a first end secured to said shaft and a second end;

an arrow guide secured to said shaft and defining an arrow notch;

a flexible line having one end attached to said second end of said lever and the remaining end attached to said cable slide;

fine position adjusting means for producing axial displacement of said shaft with respect to said body; and a spring coupled to said shaft urging rotation of said shaft in a direction which lowers said arrow guide, said shaft being rotated as said lever is pivoted rotating said arrow guide to a raised position as the bow is drawn and as the cable slide is moved upon the cable guard and said spring rotating said shaft once the drawn bow is released to lower said arrow guide.

21. A retracting arrow rest as set forth in claim 20 wherein said fine position adjusting means includes:

a threaded portion formed on said shaft;

an adjusting wheel having a threaded aperture engaging said threaded portion; and an adjuster housing rotatably coupled to said body receiving a portion of said adjusting wheel.

22. A retracting arrow rest as set forth in claim 21 wherein said arrow guide includes:

a guide support having an upper surface and a transverse notch receiving said shaft;

an elongated straight member having a first end portion overlying said upper surface and said transverse notch and a second end defining said arrow notch; and a fastener removably securing said first end portion of said elongated straight member to said upper surface of said guide support to grasp said shaft.

23. A retracting arrow rest as set forth in claim 22 wherein said elongated member includes a straight portion and an angled finger forming said arrow notch therebetween.

* * * * *